United States Patent [19]

Oguma et al.

[11] 4,123,807

[45] Nov. 7, 1978

[54] RETRACTABLE BIDET

[75] Inventors: Tomio Oguma, Anjo; Shinji Kawai, Tokyo; Naoki Minamoto, Kariya; Yuji Yamaguchi; Tetsuo Makino, both of Anjo, all of Japan

[73] Assignee: Aisin Seiki Kabushiki Kaisha, Kariya, Japan

[21] Appl. No.: 704,037

[22] Filed: Jul. 9, 1976

[30] Foreign Application Priority Data

| | | | |
|---|---|---|---|
| Aug. 8, 1975 | [JP] | Japan | 50/110227[U] |
| Sep. 1, 1975 | [JP] | Japan | 50/120558[U] |
| Jul. 10, 1975 | [JP] | Japan | 50/85007[U] |
| Jul. 25, 1975 | [JP] | Japan | 50/103934[U] |

[51] Int. Cl.[2] ..... E03D 9/08; F24H 1/00

[52] U.S. Cl. ..... 4/7; 219/296; 219/306

[58] Field of Search ..... 4/6, 7; 222/146 H, 146 HE, 222/538, 382; 219/300, 301, 296, 306; 128/251, 254, 400

[56] References Cited

U.S. PATENT DOCUMENTS

| | | | |
|---|---|---|---|
| 1,935,201 | 11/1933 | Callejo et al. | 4/7 |
| 2,504,257 | 4/1950 | Dunn | 4/7 |
| 2,872,687 | 2/1959 | Maurer | 4/7 |
| 2,875,450 | 3/1959 | Umann | 4/7 |
| 3,039,656 | 6/1962 | Wentz | 222/538 X |
| 3,594,826 | 7/1971 | Maurer | 4/7 |
| 3,841,527 | 10/1974 | Roeschlaub | 222/146 H |
| 3,947,899 | 4/1976 | Robinson et al. | 4/7 |

*Primary Examiner*—Stuart S. Levy

*Attorney, Agent, or Firm*—Burns, Doane, Swecker & Mathis

[57] ABSTRACT

In a sanitary device of the bidet type, wherein the cleansing water is warmed in a hot water tank before being ejected for cleansing purpose, the improvement wherein at least a part of the cleansing mechanism is retractable within and extendable without said hot water tank so as to be warm when use thereof is initiated.

6 Claims, 8 Drawing Figures

RETRACTABLE BIDET

FIELD

This invention relates generally to sanitary devices and more particularly to a sanitary device used in combination with a toilet bowl for automatically cleaning and drying the anus of the human body while the user is in the usual sitting position on the toilet bowl.

Sanitary devices of this general type are exemplified in the disclosure in, for instance, U.S. Pat. No. 2,875,450, in which there is associated with a conventional toilet assembly, a means for ejecting warmed water through an appropriate area and means for delivering warm drying air to such area.

Conventionally, in sanitary devices of this general character, the hot water tank and the cleansing mechanism which applies heated water to the human body (especially to the anus or the like for cleansing the same) are connected to each other by way of a pipe or pipes and, therefore, are spacially separated. In such devices, the heated water is supplied from the hot water tank to the cleansing mechanism by way of pipes, so that during hot water delivery, the heated water is cooled by passage through unheated supply pipes and the cleansing mechanism. Therefore, under an initial water ejecting operation, the first increment of water ejected from the nozzle is cold.

OBJECT OF THE INVENTION

According to the present invention, at least a part of the cleansing mechanism is located within the hot water tank for permanently warming the mechanism by the hot water in the tank, and therefore, even at initial water ejection, the water is warm and ejected, to cleanse the body comfortably.

It is, therefore, a main object of the invention to provide an improved sanitary device for cleansing the anus or other part of the body wherein a hot water tank and a cleansing mechanism are integrally formed.

It is another object of the invention to provide an improved sanitary device which is constructed compactly and less expensively by removing connecting pipes which in conventional devices connect a hot water tank with a cleansing mechanism.

It is a further object of the invention to provide an improved cleansing mechanism of the sanitary device wherein the reciprocating movements of the piston means thereof are smoothly performed by providing an anti-rotation means with the piston means.

DETAILED DESCRIPTION

Figure 2:
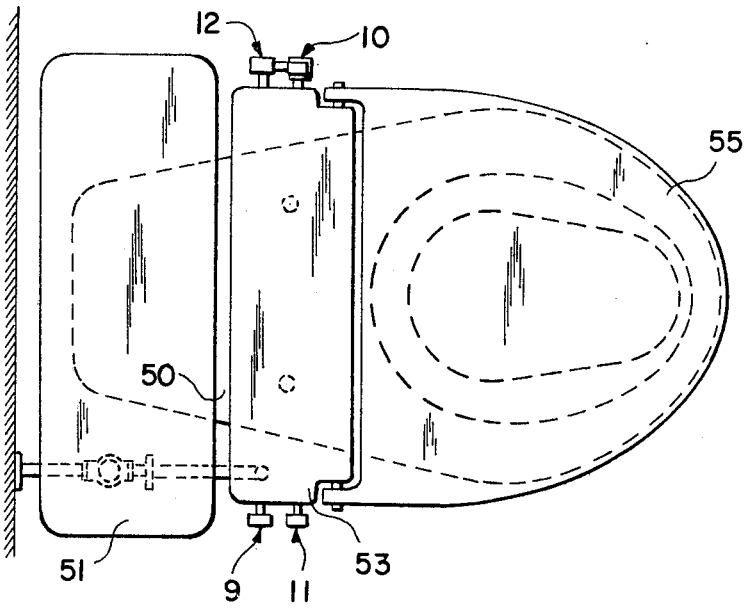
FIG. 2 is a plane view of FIG. 1.
Figure 1:
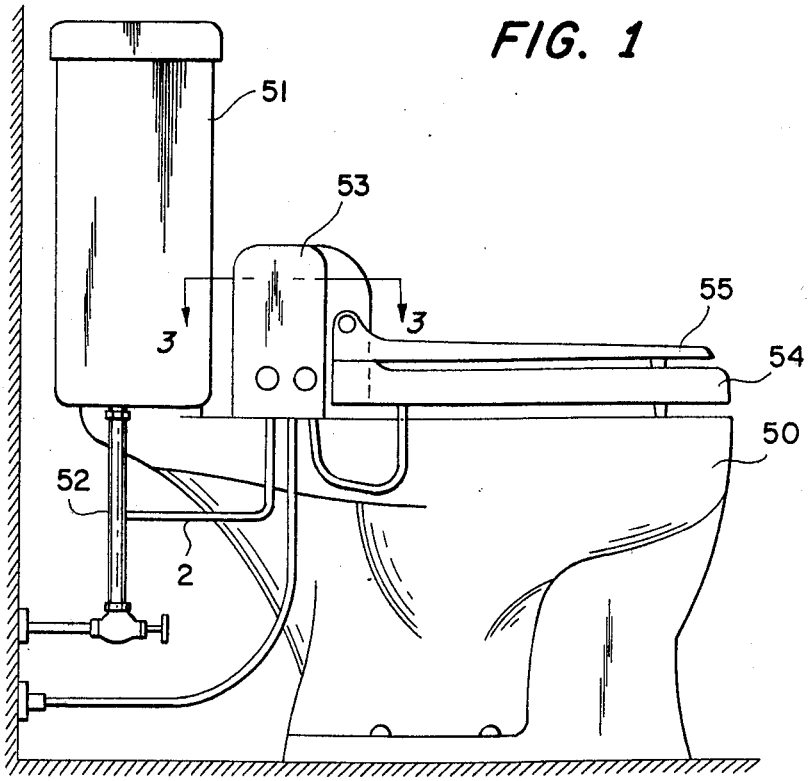
FIG. 1 is a front view of the present invention applied to a conventional toilet.

Referring particularly to FIGS. 1 and 2, the sanitary device of this invention is shown as applied to a conventional toilet which includes a bowl 50 and a water tank 51 connected thereto. The water tank 51 is connected to the sanitary device of the invention through supply pipe 52 for supplying water to the latter.

The improved device includes a housing or cover 53 which is detachably mounted on the toilet bowl 50, and seat 54 and seat cover 55 members which are pivotally mounted on the housing 53.

Figure 3:
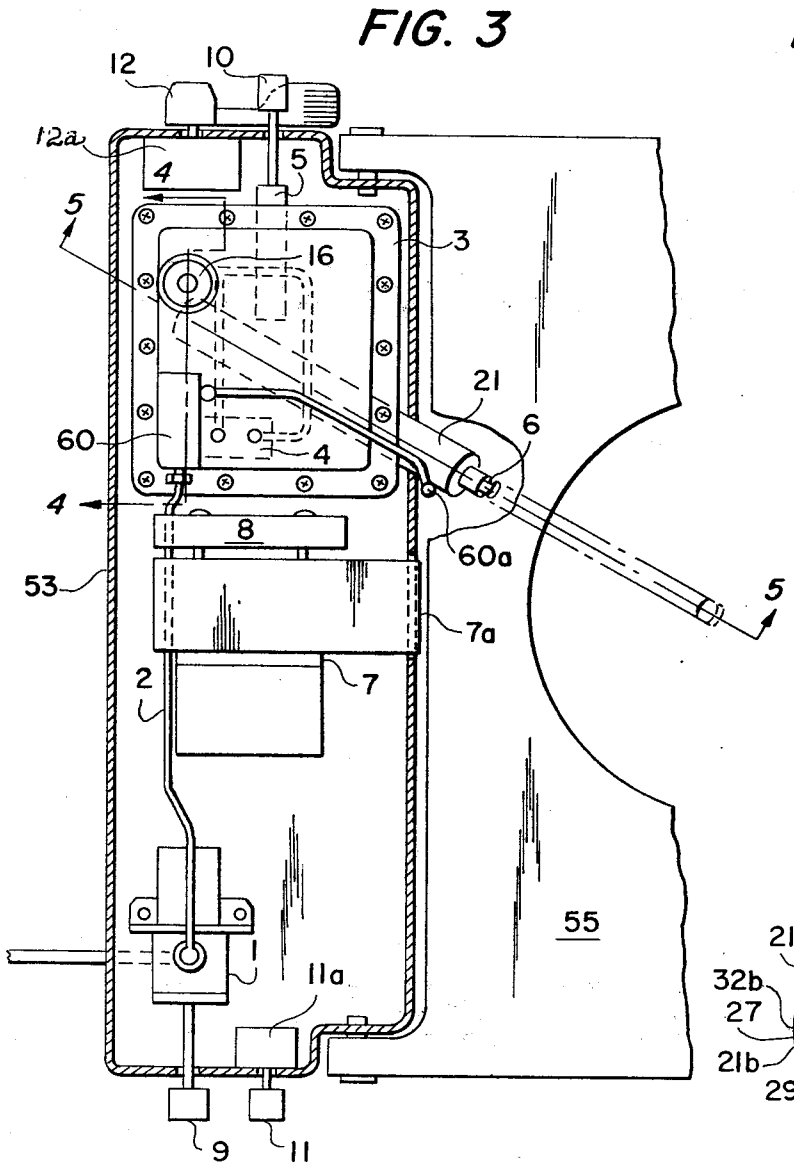
FIG. 3 is a sectional view taken along line III—III of FIG. 1.

In the housing 53 of the sanitary device, as more specifically shown in FIG. 3, an electro-magnetic valve 1 is provided within pipe 2 which connects the water supply pipe 52 (FIG. 2) with a hot water tank 3, whereby the valve 1 is actuable to control the water flow into the tank 3 by means of lever 12 which is electrically connected to the valve 1 through control circuit **12*a***.

Within the hot water tank 3, a heater device 4 is provided for heating the water supplied therein, and a thermostat 5 is connected to heater 4 for maintaining the water temperature at a desired level. This level of temperature is adjustable by means of a knob 10 which is mounted on the housing 53 and is operatively connected to the thermostat 5.

In the housing 53, a fan and fan motor device 7 and a fan heater device 8 are further provided for generating and applying warm air to the cleansed parts of the body to dry the same after a cleansing operation. The right side **7*a* of the fan device is opened to the bowl 50** to blow out the warm air.

A knob 11 is mounted on the housing 53 for controlling the air temperature of the fan heater 8. The knob 11 is electrically connected to the heater through control circuit **11*a***.

A further knob 9 is mounted on the housing 53 parallel to the knob 11 and is operatively connected to the electro-magnetic valve 1 for controlling the amount of water flow therethrough.

Lever 12 is also electrically connected to the fan heater 8 through the control circuit **12*a* for controlling the operation of the heater 8**.

FIG. 4

Now referring to water tank 3, an inlet port 13 supplies water from pipe 2 into tank 3 through an orifice valve assembly 60. The valve assembly 60 is provided on tank 3 between pipe 2 and inlet 13, and includes a valve 61 which is normally seated on a seat 62 to interrupt communication between pipe 2 and inlet 13 due to the force of spring 63. Therefore, under the normal condition (when electro-magnetic valve 1 is not actuated), inlet 13 is in communication with a passage 64 and further with a port 65. The port 65 is further in communication with the toilet bowl through any suitable pipe (**60*a* of FIG. 3) for draining the water from the tank 3 into the toilet bowl 50** after the cleansing mechanism has been actuated.

Referring now to a vacuum breaker valve assembly 16 which is also mounted on the tank 3:

The vacuum breaker valve 16 includes a casing 17 which is secured to the tank 3; and a valve member 15 the stem **15*a* of which is loosely disposed in the casing 17 for communication between a chamber 18 and the atmospheric pressure. The head 15*b* of the valve member 15 is normally seated on a seat 14*a* provided on the body of the tank 3 so that communication between the chamber 18 and the outlet 14 is interrupted. When the valve member 15 is moved upward due to the fluid pressure occurring in the tank 3, the communication between chamber 18 and the atmospheric pressure is interrupted, because the valve head 15***b* is in contact with a seat surface 17*a* of the casing 16, and instead the communication between chamber 18 and outlet 14 is established.

Figure 4:
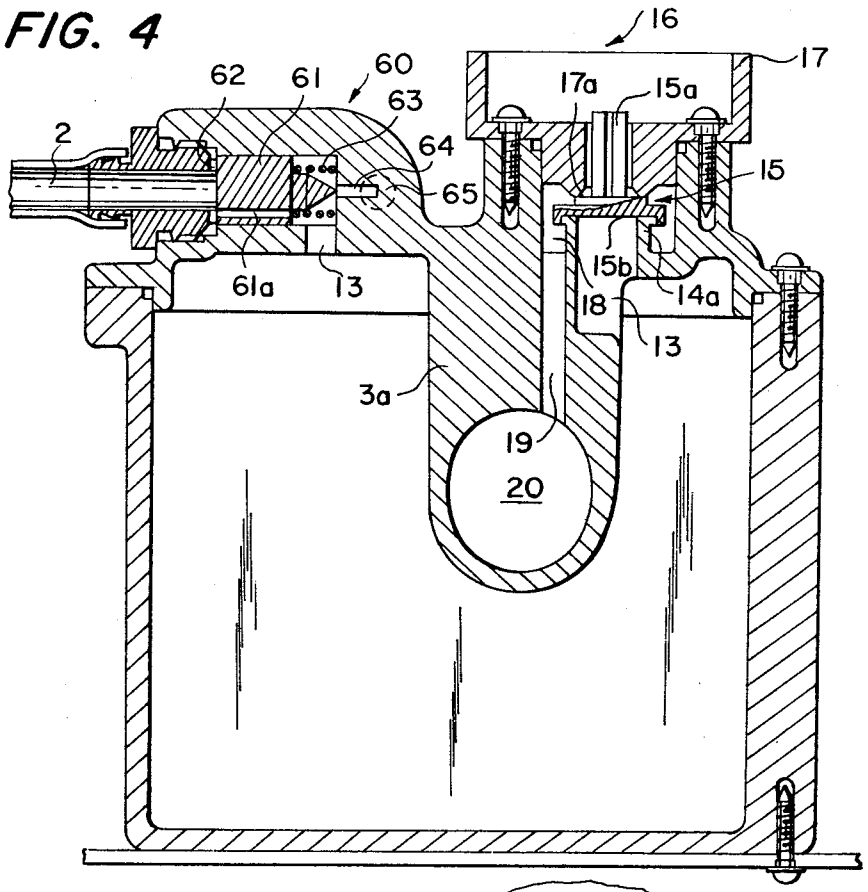
FIG. 4 is a sectional view taken along line IV—IV of FIG. 3.
Figure 5A:
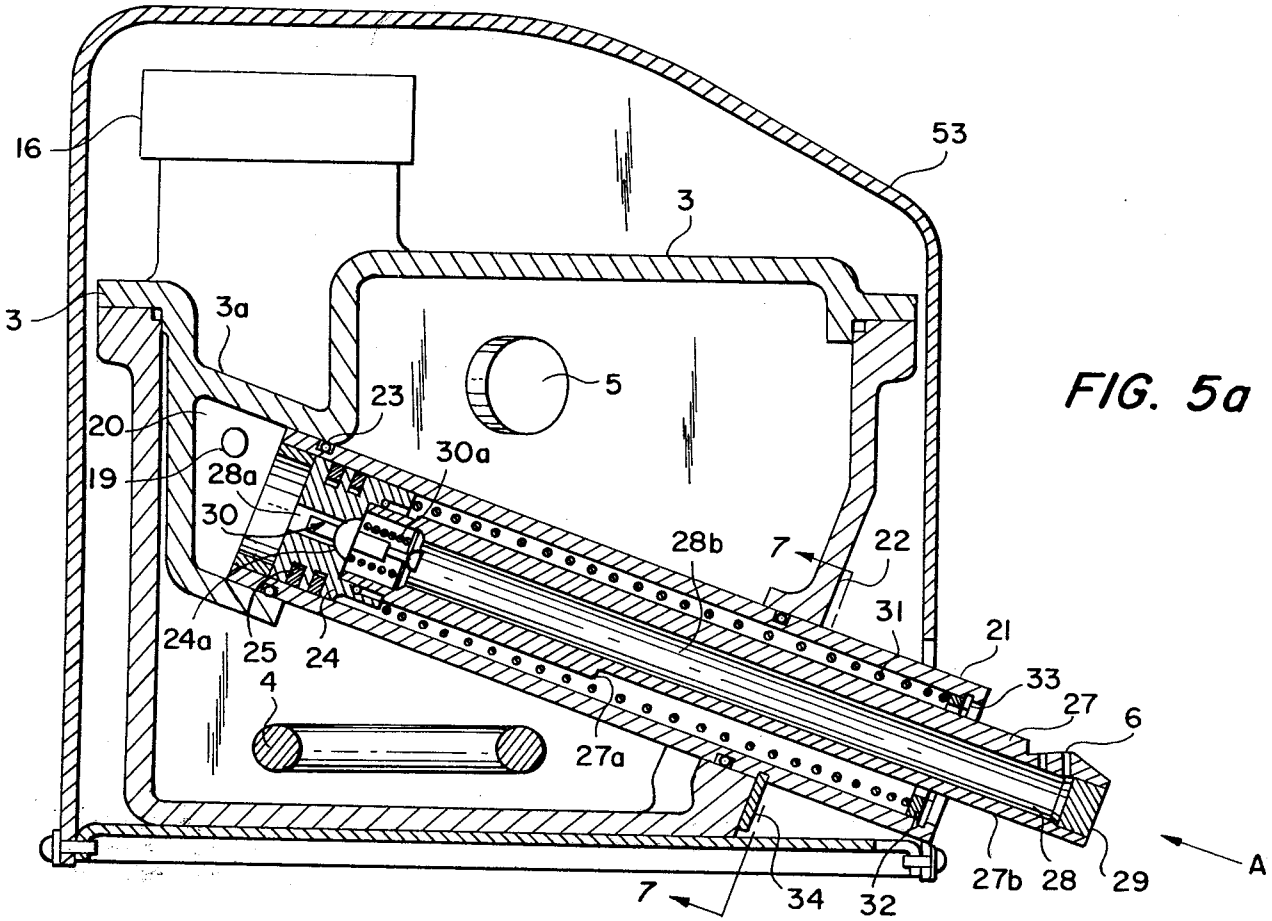
FIG. 5*a* is a sectional view taken along line V—V of FIG. 3.

FIGS. 4–5*a*

Tank 3 has an inwardly extending portion 3*a* within the same for providing the cleansing mechanism at least a part thereof being positioned within the tank 3.

Figure 7:
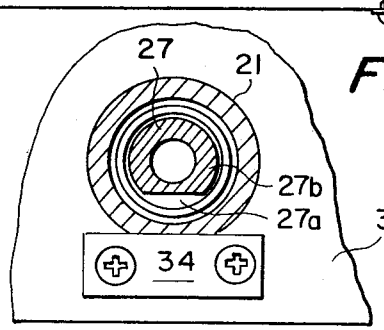
FIG. 7 is a sectional view taken along line VII—VII of FIG. 5*a*.
Figure 6:
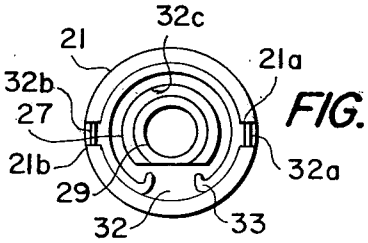
FIG. 6 is a front view of the cleansing mechanism as viewed from the arrow A of FIG. 5*a*.

The portion 3*a* of the tank has an opening 20 which receives a cylinder 21 of the cleansing mechanism. The opening 20 is in communication with chamber 18 through passage 19. Cylinder 21 is secured to tank 3 by means of a stopper plate 34 (FIGS. 5*a* and 7) for preventing the rotational and slidable movement of cylinder 21.

A piston 24 and a rod member 27 secured thereto are slidably mounted in the cylinder 21. They are movable in response to the fluid pressure in the opening 20. Piston 24 has a central bore 28*a* which communicates with opening 20 and rod member 27 has therein a central bore 28*b*.

A valve 30 is disposed between the bores 28*a* and 28*b* for normally interrupting communication therebetween. The valve 30 is biased to seat on a valve seat 24*a* provided in the piston 24 by the biasing force of spring 30*a* (status of FIG. 5). Piston 24 and rod member 27 are biased by a return spring 31 in the inoperative direction (status of FIG. 5*a*).

FIG. 6

Figure 5B:
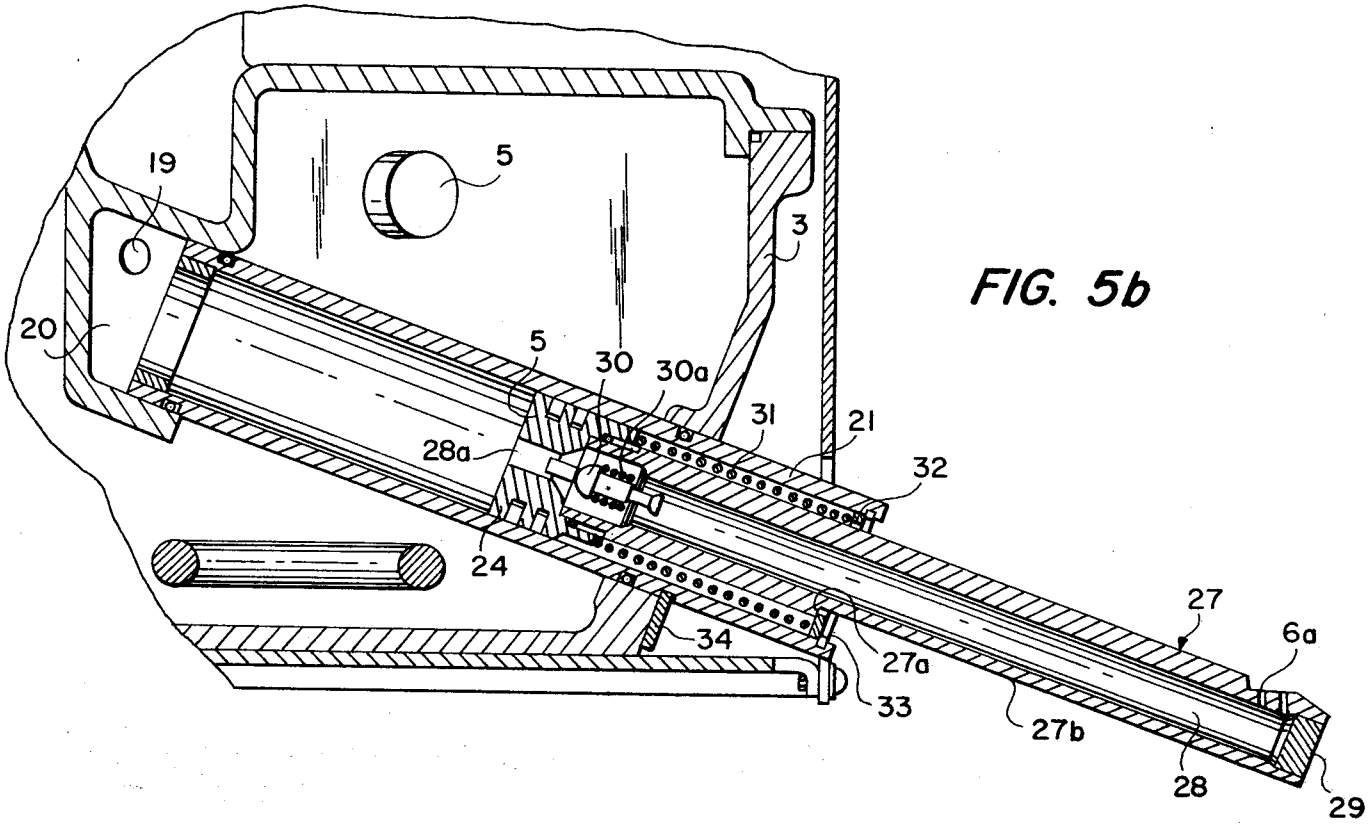
FIG. 5*b* is similar to FIG. 5*a* but showing the cleansing mechanism in its operative, extended, position.

The outer end of cylinder 21 is provided with a pair of recessed portions 21*a* and 21*b* within which are received a pair of projections 32*a* and 32*b* of a stopper 32. The stopper 32 further includes a circular bore 32*c* having a flat portion as shown. The rod member 27, which also has a flat portion 27*b* at its outer periphery, is slidably disposed in the circular bore 32*c* of stopper 32 and is slidable therein but is prevented from rotational movement. The flat portion 27*b* of rod member 27 extends from the right end for a predetermined distance thereof and terminates in a shoulder 27*a* which latter is engageable with stopper 32 when piston 24 and rod member 27 are moved in the operative direction (FIG. 5*b*). Thus a further movement thereof is restricted thereby to maintain the operative position for cleansing.

At the outer end of the rod member 27, there is provided a plug member 29 for water leakage prevention in the passage 28*b*. A plurality of nozzles 6 are provided on the rod member 27.

OPERATION

When the lever 12 (FIG. 3) is turned in one direction for cleansing purpose, the electro-magnetic valve 1 is actuated to allow water to flow into tank 3. The water in pipe 2 is transmitted to tank 3 through passage 61*a*, inlet 13 by moving the valve 61 to the right (FIG. 4) overcoming the spring force 63. At this time, the communication between port 65 and inlet 13 as well as pipe 2 is interrupted due to the rightward movement of valve 61. The water pressurized and mixed by the hot water in the tank 3 is further transmitted to the chamber 18 by pushing the valve 15 upward by the water pressure to establish communication between the tank 31 and the chamber 18.

At this time, the valve 15 is seated on the valve seat 17*a* to interrupt communication between the chamber 18 and the atmospheric pressure for maintaining the increase of water pressure.

Thus hot water in the chamber 18 is introduced into the opening 20 through passage 19 thereby to move the piston 24, as well as the rod member 27, toward the right as viewed in FIG. 5*a* due to the water pressure in the opening 20.

It should be noted that the spring force of the valve spring 30*a* is selected to be greater than that of the return spring 31. Therefore, the valve 30 is at this time in the position shown in FIG. 5*a* so as not to establish the communication between the passage 28*a* and the passage 28*b*.

FIG. 5*b*

When the piston 24 and the rod member 27 are moved to the position of FIG. 5*b*, the shoulder 27*a* of the rod member 27 is engaged with the stopper 32 thereby restricting further movement thereof.

Under such conditions, due to the increase of the pressure in the opening 20, the valve 30 is opened to establish communication between passages 28*a* and 28*b* overcoming the biasing force of the spring 30*a* (FIG. 5*b*). Thus the hot water introduced into the passage 28*b* is emitted from the nozzles 6 to effect the desired cleansing function on the anus and/or adjacent parts of the body of the seated user.

After cleansing, when the lever 12 is returned to the original position, the electro-magnetic valve 1 is actuated to stop the water supply.

Since there has been no pressure existing in the opening 20, the valve 30 is returned to its original position (seated on the valve seat 24*a*) due to the force of spring 30*a* thereby stopping the water ejection from the nozzles 6. At the same time, the remaining water in the opening 20 is returned to the chamber 18 and the valve 15 is maintained in its upward position by the pressure in the opening 20. Thus the returned water is introduced into the tank 3 and further to the port 65 (the valve 60).

The valve 61 is returned to the left to interrupt the communication between the pipe 2 and the passage 61*a* and, instead, communication between the inlet port 13 and the passage 64 is established.

Thus superfluous water in the tank 3 as well as in the opening 20 is emitted into the toilet bowl 50.

Now referring to FIG. 5*a* and FIG. 5*b*, the piston 28 and the rod member are returned to the original position with the valve 30 being closed. This returning movement is provided by the provision of the drain circuit (20→19→18→14→3→13 64→65→bowl ) as described.

Having fully returned the piston and rod member, when the lever 12 is then turned in the opposite direction, fan heater 8 as well as fan motor 7 are actuated to generate warm air which is blown from the portion 7*a* to dry the cleansed parts of the body of the seated user.

We claim:

1. A sanitary device for association with a toilet seat of the type having a central opening and an upper portion adapted to be contacted by a portion of the body of a user, said sanitary device comprising a fluid pressure source;

a hot water tank connected with said fluid pressure source;

a heater within said tank for heating water therein to a predetermined temperature; and a cleansing mechanism comprising a cylinder disposed within said tank so as to be heated by heated water in said tank, said cylinder being outwardly open, a piston section mounted in said cylinder for sliding movement between inward and outward positions therein, a passage-defining section extending from said piston section and defining a passage, at least a substantial portion of said passage disposed within said cylinder when said piston section is in its inward position, for being heated by said heated cylinder, a nozzle section at an outer end of said passage-defining section and communicating with said passage for spraying heated water into an area to be cleansed, and means communicating said piston section with pressurized water in said tank for sliding said piston section outwardly to extend said passage-defining section outwardly of said cylinder with minimal cooling of water occurring during travel of said water through said heated passage-defining section.

2. A sanitary device according to claim 1, wherein said cleansing mechanism further includes a pressure-operated valve means provided within the piston section and normally interrupting fluid communication between water in said tank and said nozzle section, said valve means bieng movable together with said piston section.

3. A sanitary device according to claim 3, wherein said piston section of the cleansing mechanism is positioned in said inward position when no fluid pressure exists in said tank and is movable to said outward position when the fluid pressure reaches a first predetermined value, said valve means is actuated to establish fluid communication between said water tank and said passage when fluid pressure in said tank reaches a second predetermined value which is larger than the first predetermined value.

4. A sanitary device according to claim 3, wherein a stopper means is provided on said cylinder for restricting further movement of said piston section when it reaches said outward position.

5. A sanitary device according to claim 3, further including a second valve means comprising a casing mounted on said hot water tank, a valve member having a head and a stem, the stem loosely disposed in said casing for communication between said nozzle section and the atmosphere, said tank including a water outlet with a seat and the head of said valve member normally seated on said seat preventing communication between said nozzle section and the outlet when said valve member is moved upwardly by fluid pressure emanating from said tank for establishing communication between said tank and said nozzle section.

6. A sanitary device according to claim 3, wherein communication between said fluid pressure source and said hot water tank is provided by an orifice valve assembly comprising an inlet pipe extending from said source, a valve seat on said inlet pipe, a valve element normally seated on said seat under the force of a biasing spring and movable away from said valve seat under the urging of water pressure in said inlet pipe.

* * * * *